US010353319B2

(12) United States Patent
Tsuda

(10) Patent No.: US 10,353,319 B2
(45) Date of Patent: Jul. 16, 2019

(54) DEVELOPING APPARTUS HAVING A FEEDING MEMBER WITH RADIAL PROJECTIONS

(71) Applicant: CANON KABUSHIKI KAISHA, Tokyo (JP)

(72) Inventor: Shunsuke Tsuda, Tokyo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/045,853

(22) Filed: Jul. 26, 2018

(65) Prior Publication Data

US 2019/0033751 A1 Jan. 31, 2019

(30) Foreign Application Priority Data

Jul. 31, 2017 (JP) ..... 2017-148551

(51) Int. Cl.
*G03G 15/08* (2006.01)

(52) U.S. Cl.
CPC ..... *G03G 15/0891* (2013.01); *G03G 15/0865* (2013.01); *G03G 2215/083* (2013.01)

(58) Field of Classification Search
CPC ..... G03G 15/0891; G03G 15/0865; G03G 15/0808; G03G 15/0812; G03G 2215/083; G03G 15/163; G03G 15/0877; G03G 2221/1657; G03G 21/1647
See application file for complete search history.

(56) References Cited

U.S. PATENT DOCUMENTS 5,659,859 A * 8/1997 Kikuta ..... G03G 15/0822 399/256
5,963,766 A * 10/1999 Okuno ..... G03G 15/0822 399/254
2006/0204283 A1* 9/2006 Yasuda ..... G03G 15/0893 399/254

(Continued)

FOREIGN PATENT DOCUMENTS

JP 2008-256917 A 10/2008
JP 2017-097082 A 6/2017

OTHER PUBLICATIONS

Osamu Ariizumi, U.S. Appl. No. 15/982,023, filed May 17, 2018.

*Primary Examiner* — David M. Gray
*Assistant Examiner* — Laura Roth
(74) *Attorney, Agent, or Firm* — Venable LLP

(57) ABSTRACT

A developing device includes a developer sleeve, a developer container, a partition partitioning the developer container into first and second chambers with first and second ports and first and second feeding members provided in respective chambers. The first feeding member includes a rotation shaft, a first helical portion on an outer periphery of the rotation shaft, a first plate-like radial projection on the rotation shaft at a position opposed to the second port in a downstream side of the first helical portion, and a second plate-like radial projection on the rotation shaft at a position which is opposed to the second port in a downstream side of the first plate-like radial projection and which is spaced from the first plate-like radial projection in a phase. A surface of the first plate-like radial projection and a surface of the second plate-like radial projection are inclined relative to a rotational axis of the rotation shaft.

7 Claims, 14 Drawing Sheets

(56) References Cited

U.S. PATENT DOCUMENTS

| | | | | |
|---|---|---|---|---|
| 2008/0069580 | A1* | 3/2008 | Oshige | G03G 15/0893 399/62 |
| 2008/0145109 | A1* | 6/2008 | Murayama | G03G 15/0877 399/260 |
| 2014/0205326 | A1* | 7/2014 | Nakamura | G03G 15/0877 399/255 |
| 2017/0068187 | A1* | 3/2017 | Ueno | G03G 21/105 |

* cited by examiner

DEVELOPING APPARTUS HAVING A FEEDING MEMBER WITH RADIAL PROJECTIONS

FIELD OF THE INVENTION AND RELATED ART

The present invention relates to a developing apparatus for developing an electrostatic latent image.

There are various image forming apparatuses in terms of function. For example, there are copying machines, facsimileing machines, printing machines, and multifunction machines capable of performing two or more functions of the preceding examples of image forming apparatus. From the standpoint of image forming technology, there are image forming apparatuses which use an electrophotographic image forming technology. Generally speaking, in the field of image forming apparatuses which use an electrophotographic image forming technology, two-component developer which is made up of toner and carrier has been widely used. The internal space of the developing apparatus of most of the image forming apparatuses of this type, is divided into two chambers, through which developer is conveyed, while being stirred, by a conveyance screw so that the developer is circulated through the developing apparatus.

Thus, the partitioning wall between the two chambers is provided with a pair of through holes, which are at the lengthwise ends of the wall, one for one. In order to improve a developing apparatus in the efficiency with which developer is transferred from one chamber to the other, some developing apparatuses are structured so that the more downstream it is in terms of the developer conveyance direction, the greater the lead angle of the spiral blade of the conveyance screw (Japanese Laid-open Patent application No. 2008-256917). In these developing apparatuses, the conveyance screw is provided with a paddle portion having a blade (blades) which is parallel to the axial line of the conveyance screw. The paddle portion is positioned to face one of the aforementioned through holes so that developer is transferred from one chamber to the other by the paddle portion through one of the through holes.

However, if a developing apparatus is structured so that a paddle portion having such blades that are parallel to the axial line of the conveyance screw extends from one end of the through holes to the other in terms of the developer conveyance direction, paddles lift developer in the direction parallel to the rotational direction of the conveyance screw, by an amount greater than the necessary amount as the conveyance screw rotates.

In a case where developer is lifted by the paddle portion by an amount greater than the necessary amount, all the lifted developer is not transferred from one chamber to the other through the through hole. Thus, the developer which was lifted by the paddle portion, but was not transferred to the other chamber, slides off from the paddle portion, and collects in the downstream end portion of the chamber. Further, as developer is lifted by the paddle portion by the amount greater than the necessary amount, the portion of the chamber, in which developer was lifted by the paddle portion becomes less in developer density. Thus, the developer which was moved to the through hole returns to the portion of the chamber, which became less in developer density. Thus, it is possible that the developing apparatus will reduce in the overall efficiency with which developer is transferred from one chamber to the other.

SUMMARY OF THE INVENTION

Thus, the primary object of the present invention is to provide a developing apparatus capable of more efficiently transferring developer from one of its two chambers to the other than any conventional developing apparatus, and also, to provide an image forming apparatus having such a developing apparatus.

According to an aspect of the present invention, there is provided a developing device comprising a developer carrying member configured to carry a developer; a developer container configured to accommodate the developer to be supplied to said developer carrying member; a partition partitioning said developer container into a first chamber and a second chamber and is provided with first and second communication ports for fluid communication between said first chamber and said second chamber; a first feeding member provided in said first chamber and configured to feed the developer in a first direction from said first communication port toward said second communication port; and a second feeding member provided in said second chamber and configured to feed the developer in a second direction opposite to the first direction, wherein said first feeding member includes a rotation shaft, a first helical portion provided on an outer periphery of said rotation shaft and configured to feed the developer in the first direction, a first plate-like projection projecting in a radial direction from the outer periphery of said rotation shaft at a position opposed to said second communication port in a downstream side of said first helical portion with respect to the first direction, and a second plate-like projection projecting in the radial direction from the outer periphery of said rotation shaft at a position which is opposed to said second communication port in a downstream side of said first projection with respect to the first direction and which is different from said first projection in a phase with respect to a rotational moving direction of said rotation shaft, said second projection being spaced from said first projection, wherein a surface of said first projection and a surface of said second projection are inclined relative to a rotational axis of the rotation shaft.

Further features of the present invention will become apparent from the following description of exemplary embodiments (with reference to the attached drawings).

Figure 5:
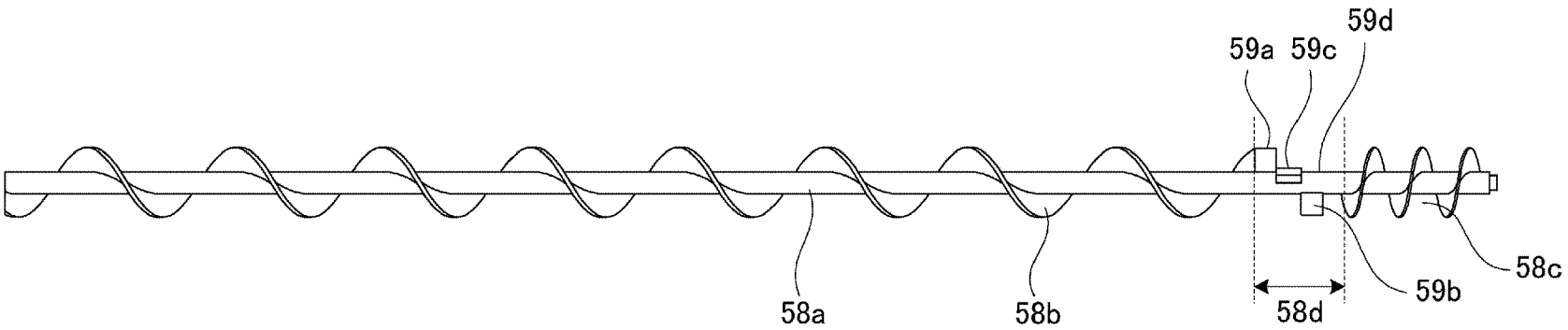
FIG. 5 is a side view of one of the conveyance screws; it is for showing the structure of the screw.
Figure 6:
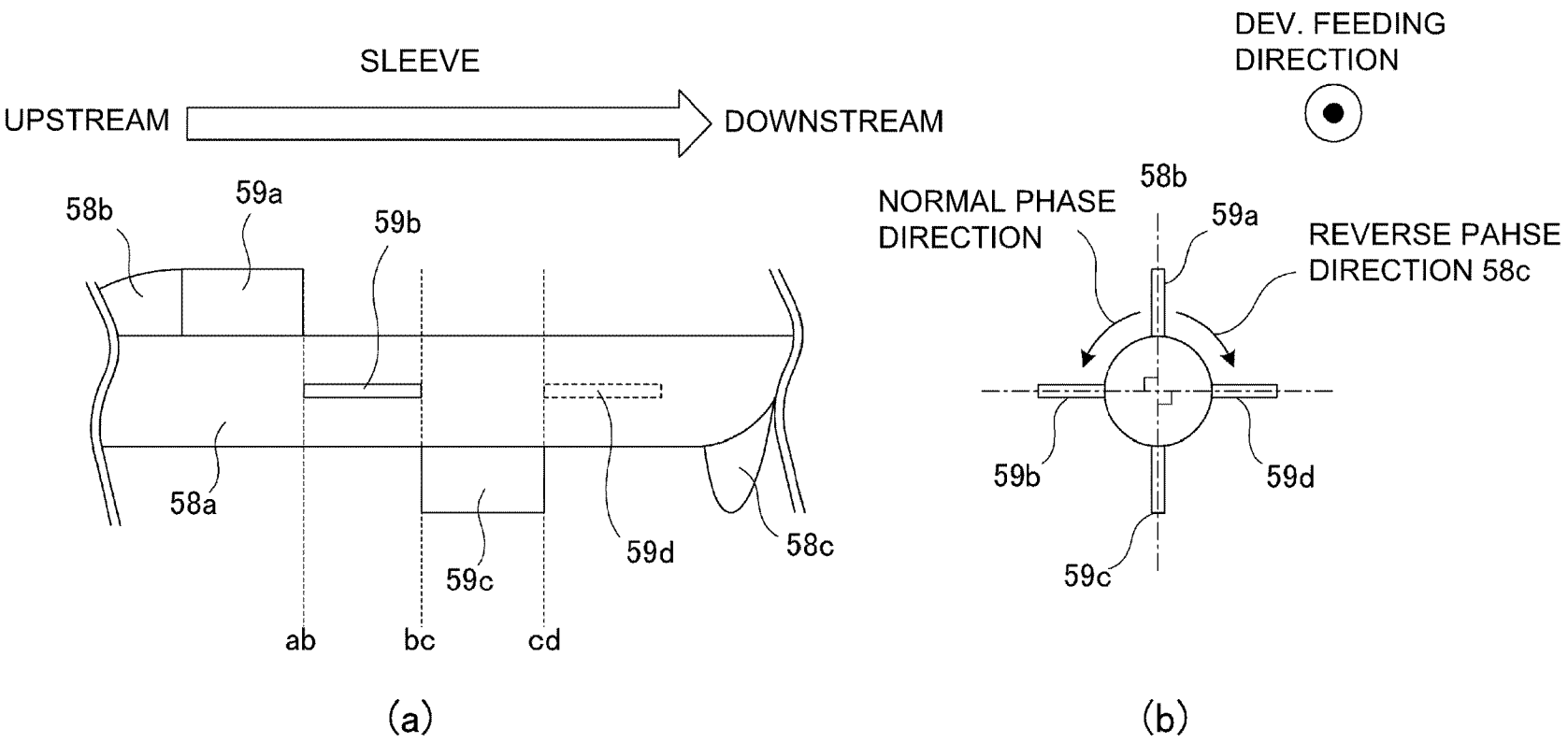

Part (a) of FIG. 6 is a side view of the portion of the conveyance screw, which has paddles, and part (b) of FIG. 6 is a front view of the conveyance screw shown in FIG. 5.

Figure 7:
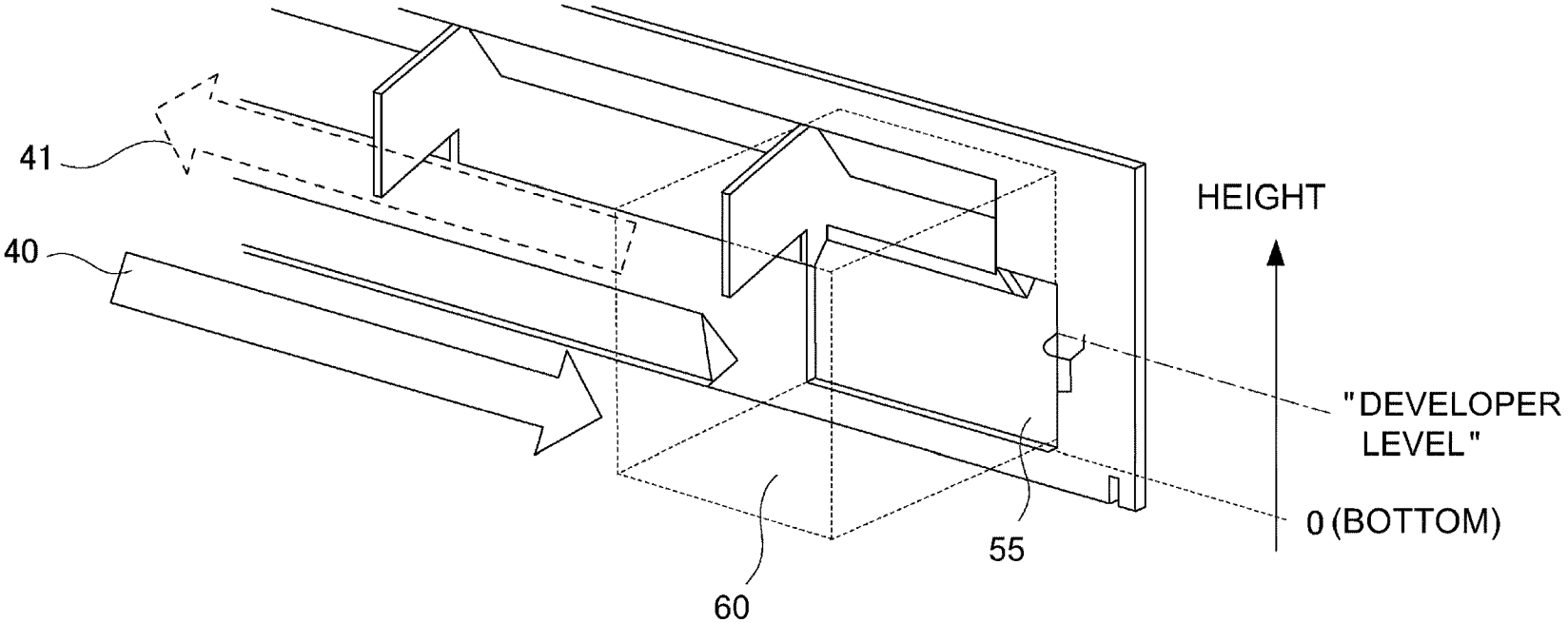

FIG. 7 is a perspective view of the through hole and its adjacencies in the developing apparatus.

Figure 8:
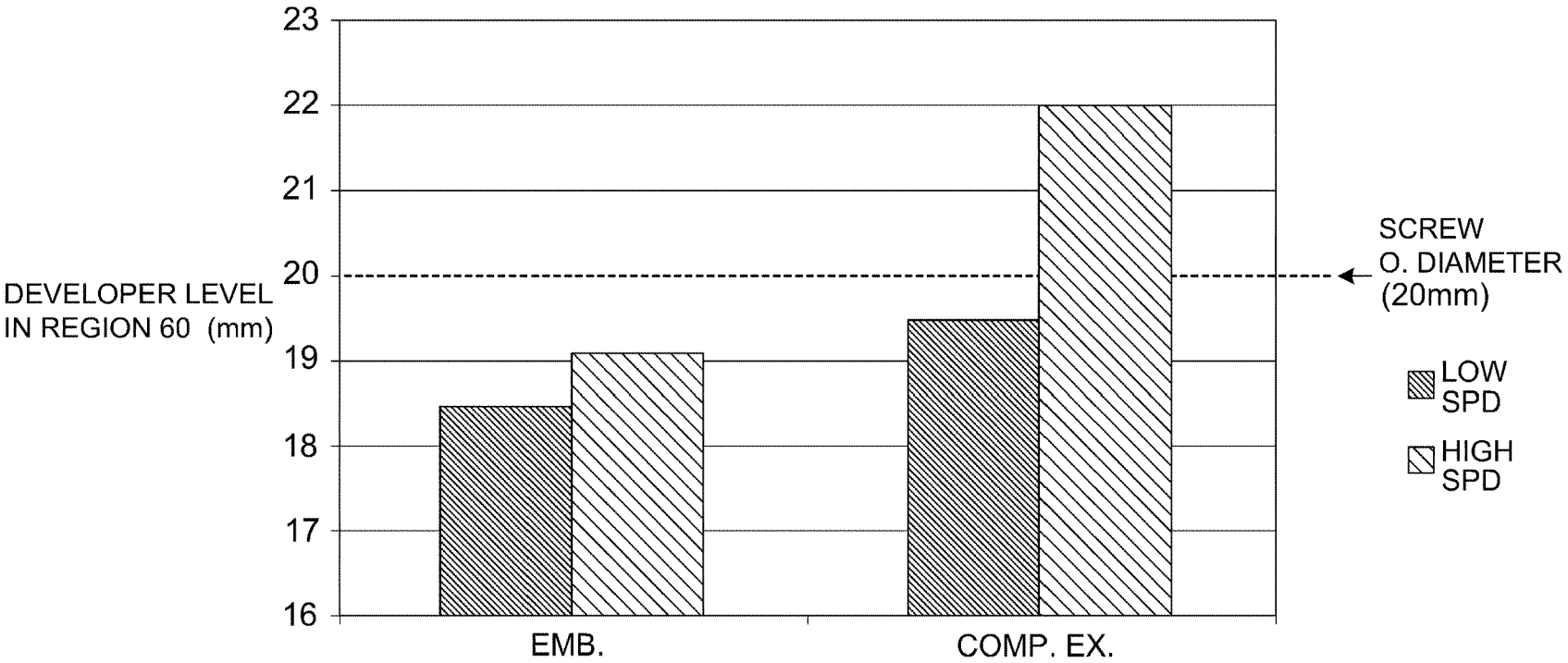

FIG. 8 is a graph which shows the relationship between the height of the top surface of the body of developer in the area which corresponds in position to one of the through holes, and the rotational speed of the conveyance screw, in the first embodiment and a comparative (conventional) developing apparatus.

Figure 9:
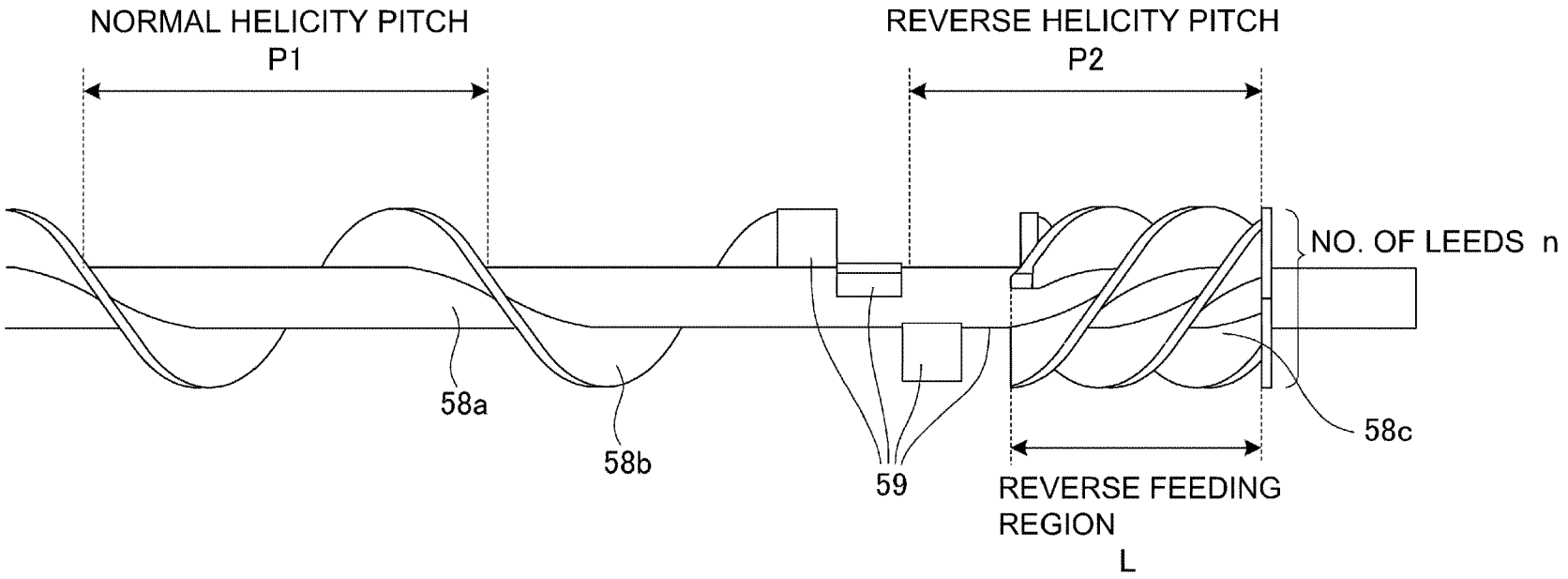

FIG. 9 is a drawing for showing the structure of one of the conveyance screws in the second embodiment of the present invention.

Figure 10:
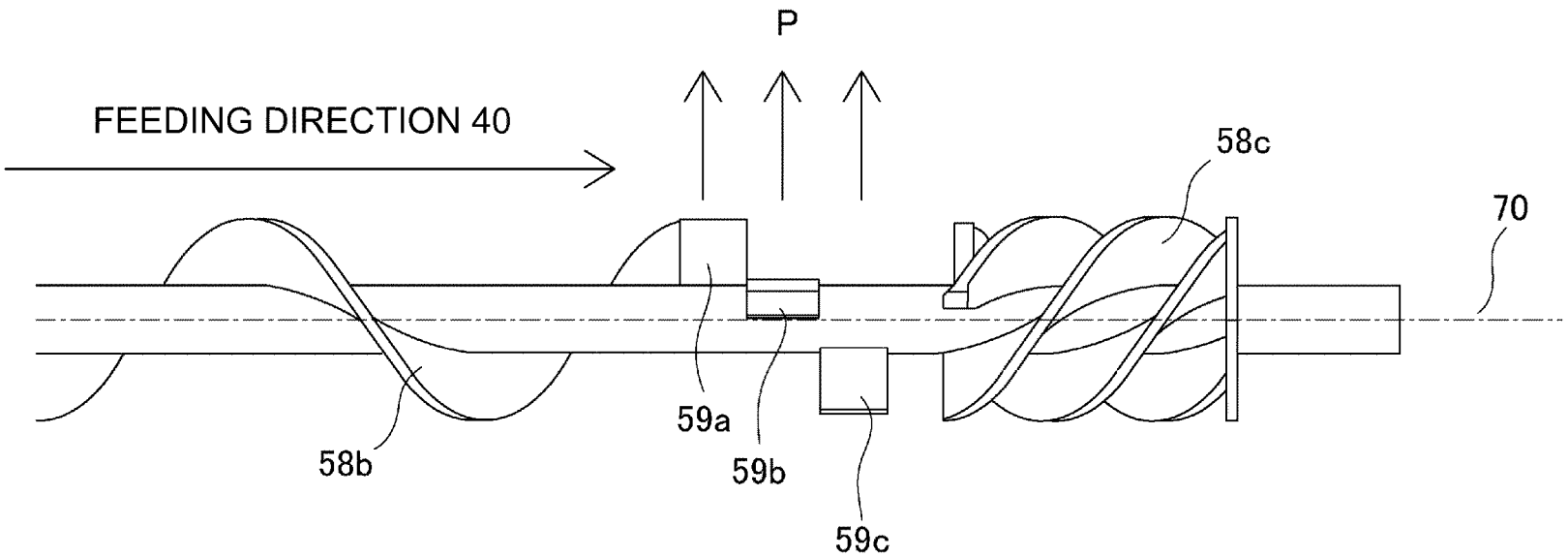

FIG. 10 is a drawing for showing the relationship between the paddles, and the rotational axis of the conveyance screw.

Figure 11:
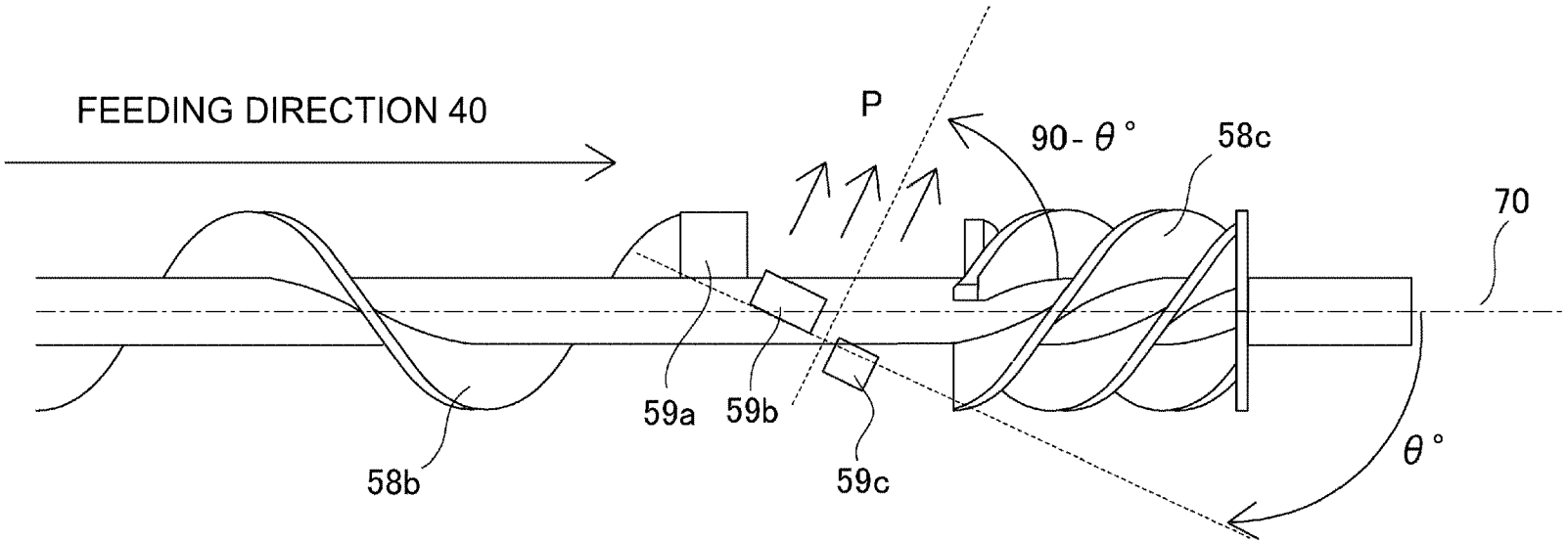

FIG. 11 is a drawing for showing the structure of the conveyance screw in the third embodiment of the present invention.

Figure 12:
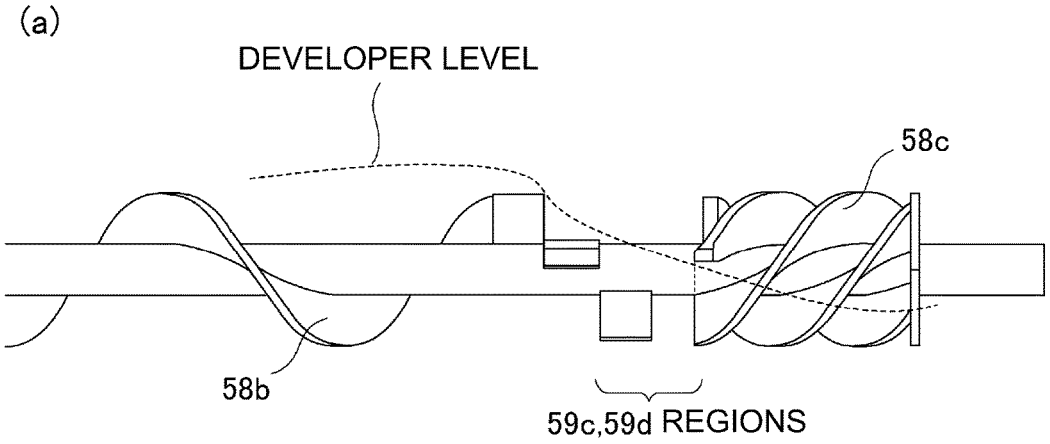
Figure 12:
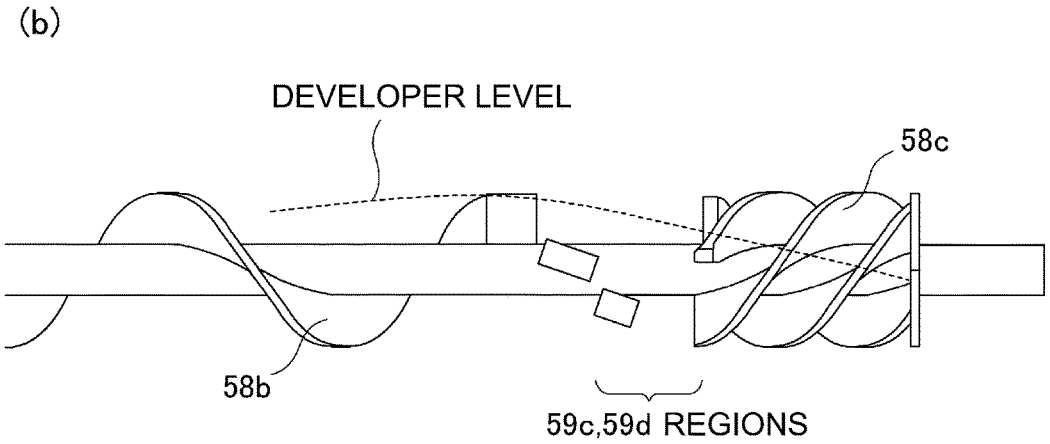

Part (a) of FIG. 12 is a drawing for showing the height of the top surface of the body of developer in the stirring chamber having the conveyance screw shown in FIG. 9, and part (b) of FIG. 12 is a drawing for showing the height of the top surface of the body of developer in the stirring chamber having the conveyance screw shown in FIG. 11.

Figure 13:
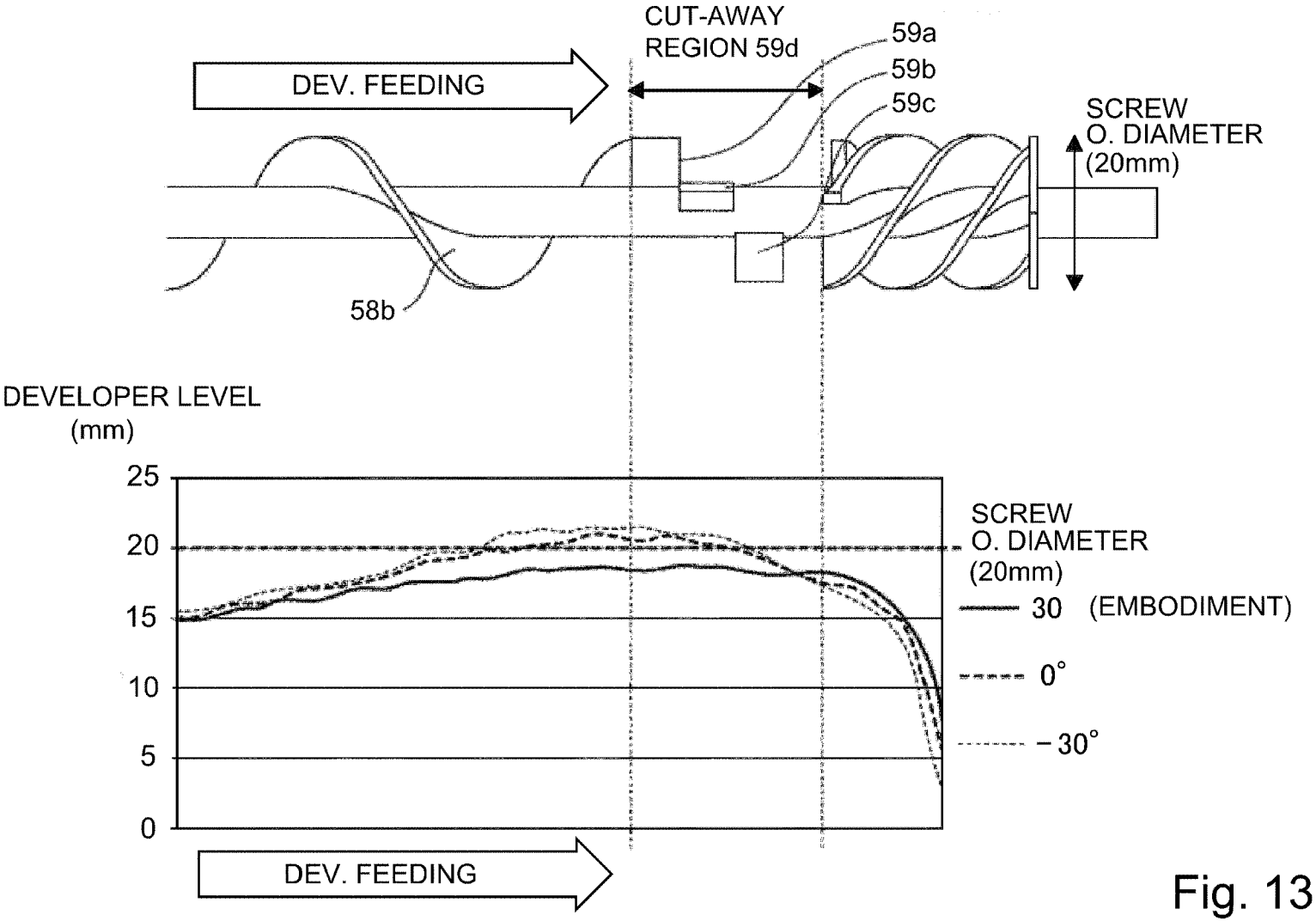

FIG. 13 is drawing for showing the height of the top surface of the body of developer, and the angle of the paddles.

Figure 14:
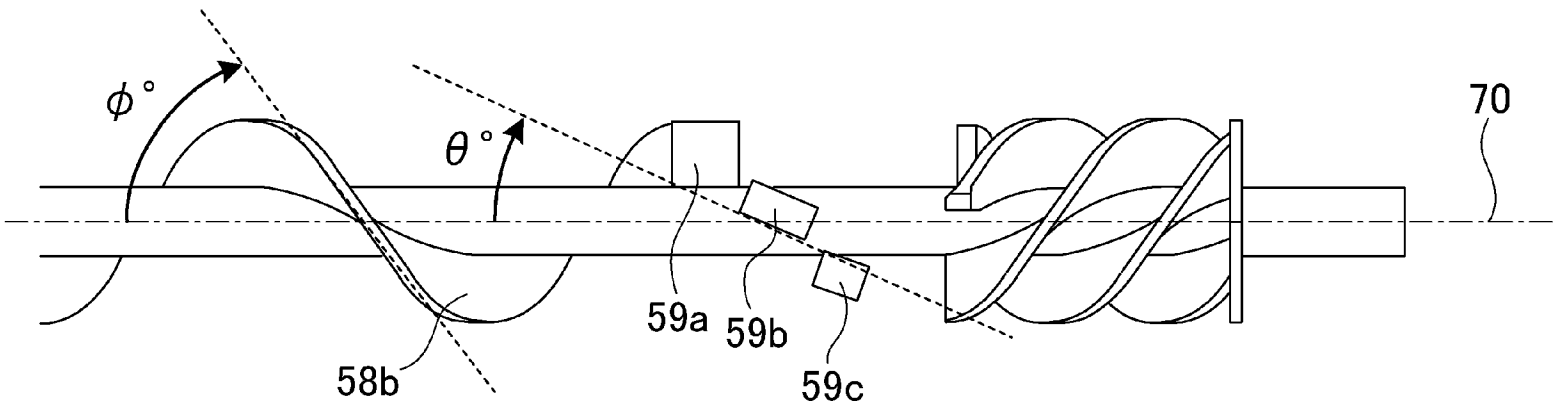

FIG. 14 is a drawing for describing the relationship between the normally spiraled blade, and the paddle angle.

DESCRIPTION OF THE EMBODIMENTS

Embodiment 1

[Overall Structure]

Figure 1:
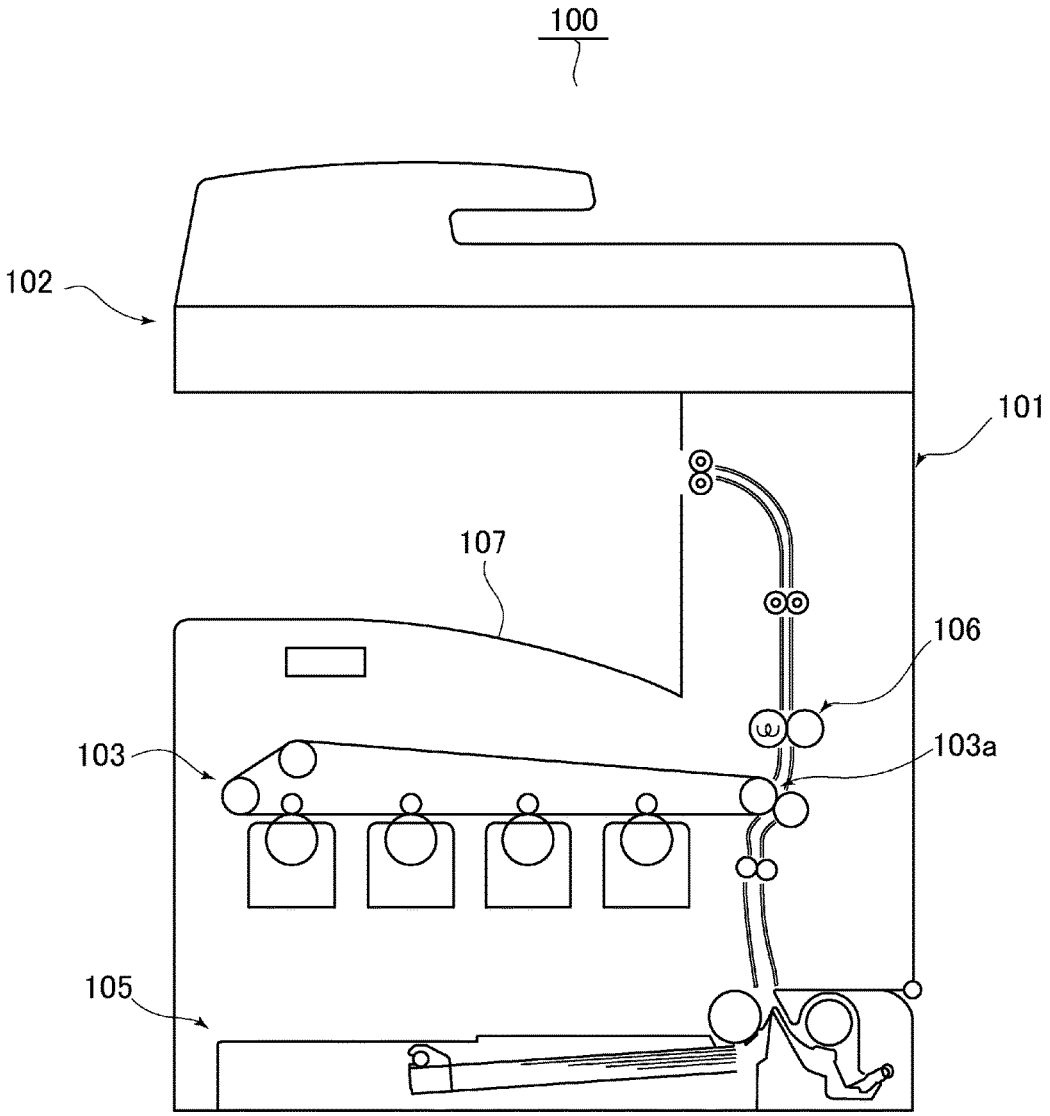
FIG. 1 is a schematic sectional view of the image forming apparatus in the first embodiment of the present invention; it is for showing the structure of the image forming apparatus.

First, a printer 100, which is an image forming apparatus in accordance with the present invention, is described with reference to appended drawings. Referring to FIG. 1, the printer 100 is a full-color laser printer. It employs an electrophotographic image forming method. It has a main assembly 101 and an image reading apparatus 102. Further, it has: an image forming portion 103 which forms an image on a sheet of recording medium; a sheet conveying portion 105 which conveys a sheet of recording medium to the image forming portion 103; and a fixing apparatus 106 which fixes a toner image formed by the image forming portion 103, to a sheet of recording medium.

After being fed into the main assembly 101 by the sheet conveying portion 105, a sheet of recording medium is conveyed to the secondary transfer portion 103*a* of the image forming portion 103, in which the toner image formed by the image forming portion 103 is transferred onto the sheet. After the transfer of the toner image onto the sheet, the sheet is conveyed to the fixing apparatus 106 which is disposed on the downstream side of a secondary transfer portion 103*a* in terms of the sheet conveyance direction. In the fixing apparatus 106, the sheet and the toner image thereon are heated and pressed.

Consequently the toner image is fixed to the sheet. Thereafter, the sheet, to which the toner image has just been fixed, is discharged into a delivery tray 107.

[Details of Structure of Image Forming Portion]

Figure 2:
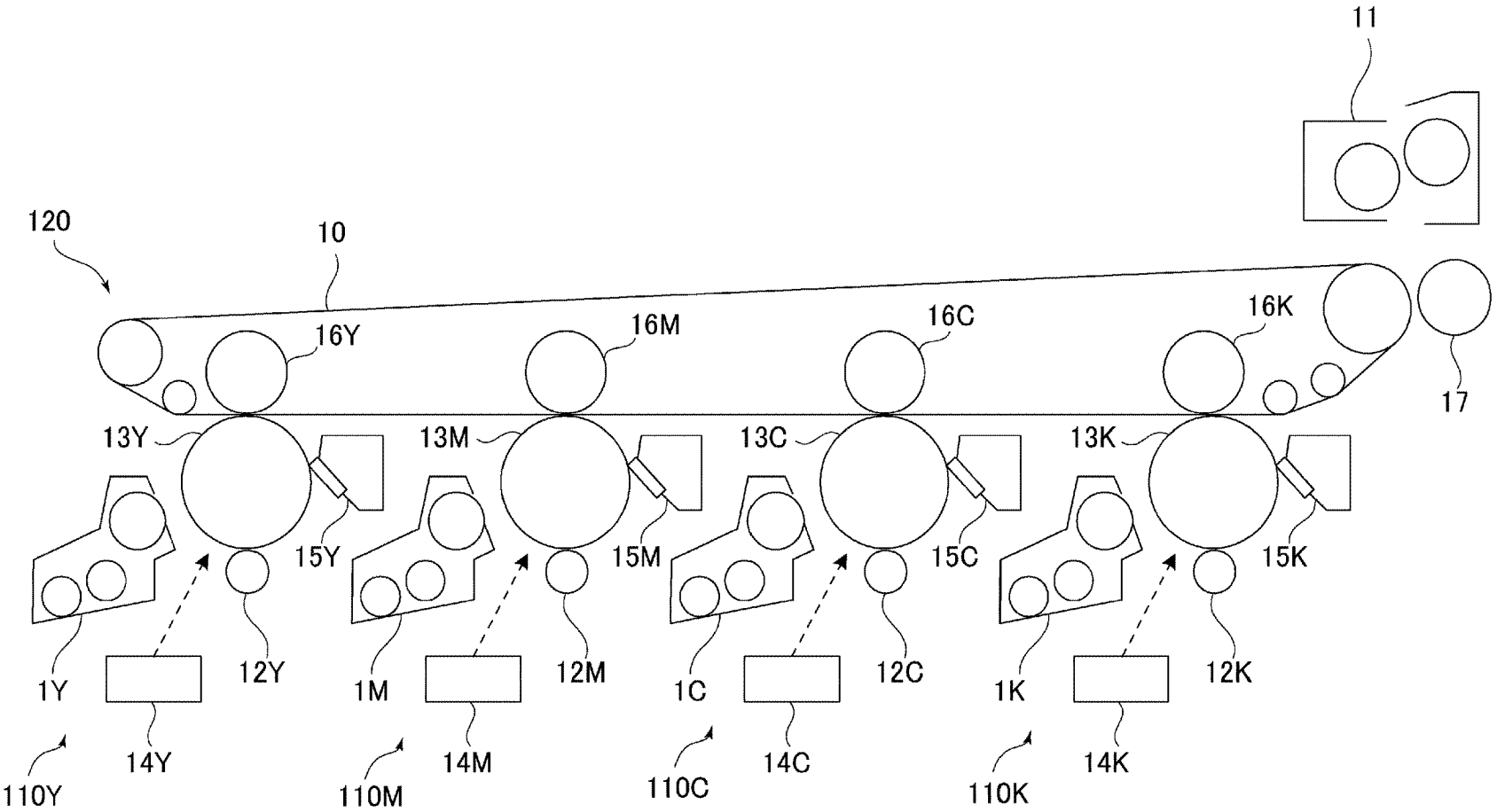
FIG. 2 is a schematic sectional view of the image forming portion of the image forming apparatus shown in FIG. 1.

Next, referring to FIG. 2, the details of the structure of the image forming portion 103 are described. Referring to FIG. 2, the image forming portion 103 in this embodiment is of the so-called tandem type. It employs four process cartridges 110Y-110K. It has also an intermediary transfer unit 120. The aforementioned four process cartridges 110Y-110K, which form yellow, magenta, cyan, and black toner images, respectively, are disposed in tandem in parallel along the intermediary transfer belt 10 of the intermediary transfer unit 120.

More concretely, the four process cartridges 110Y-110K have photosensitive drums 13Y-13K, respectively, as photosensitive members, on which toner images are formed one for one. The image forming portion 103 is also provided with primary charging devices 12Y-12K, exposing apparatuses 14Y-14K, developing apparatus 1Y-1K, primary transfer rollers 16Y-16K, and cleaning apparatuses 15Y-15K, which are disposed in the listed order in a manner to surround the corresponding photosensitive drums, one for one.

Thus, the peripheral surface of each of the photosensitive drums 13Y-13K is uniformly charged by the primary charging devices 12Y-12K, respectively. Then, the uniformly charged portion of the peripheral surface of each of the photosensitive drums 13Y-13K is scanned by (exposed to) a beam of laser light emitted by the exposing apparatuses 14Y-14K, respectively. Consequently, an electrostatic latent image, which reflects the information of the image to be formed, is formed on each of the photosensitive drums 13Y-13K. These electrostatic latent images are developed by the developing apparatuses 1Y-1K, one for one. Consequently, yellow, magenta, cyan and black toner images are formed on the peripheral surface of the photosensitive drums 13Y-13K, respectively.

On the downstream side of the developing apparatuses 1Y-1K in terms of the rotational direction of the photosensitive drums 13Y-13K, respectively, there are primary transfer portions, which are formed by the combination of the primary transfer rollers 16Y-16K and photosensitive drums 13Y-13K, respectively. In the primary transfer portions, the primary transfer bias is applied to the primary transfer rollers 16Y-16K. As the primary transfer bias is applied, the yellow, magenta, cyan and black toner images on the photosensitive drums 13Y-13K, respectively, are sequentially transferred in layers onto the intermediary transfer belt 10 by the primary transfer bias. Consequently, a full-color toner image is effected on the intermediary transfer belt 10. Then, the full-color toner image on the intermediary transfer belt 10 is conveyed to the secondary transfer portion 103*a*, described above, by the intermediary transfer belt 10. In the secondary transfer portion 103*a*, the secondary transfer bias is applied to the secondary transfer roller 17. As the secondary transfer bias is applied, the full-color toner image on the intermediary transfer belt 10 is transferred onto the aforementioned sheet of recording medium by the secondary transfer bias. By the way, the toner remaining on the peripheral surface of the photosensitive drums 13Y-13K after the secondary transfer of the toner images is removed by the cleaning apparatuses 15Y-15K, respectively.

[Developing Apparatus]

Figure 3:
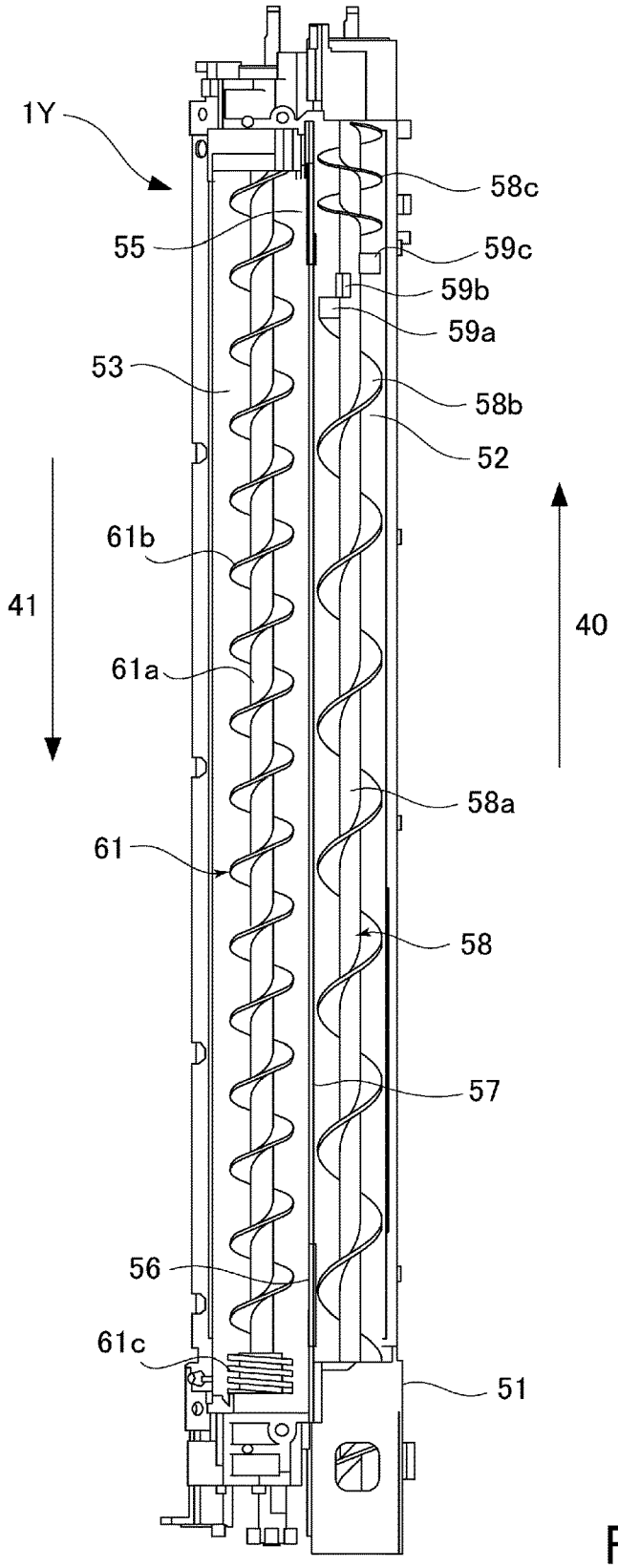
FIG. 3 is a top view of the developing apparatus in the first embodiment, after the removal of its top lid.
Figure 4:
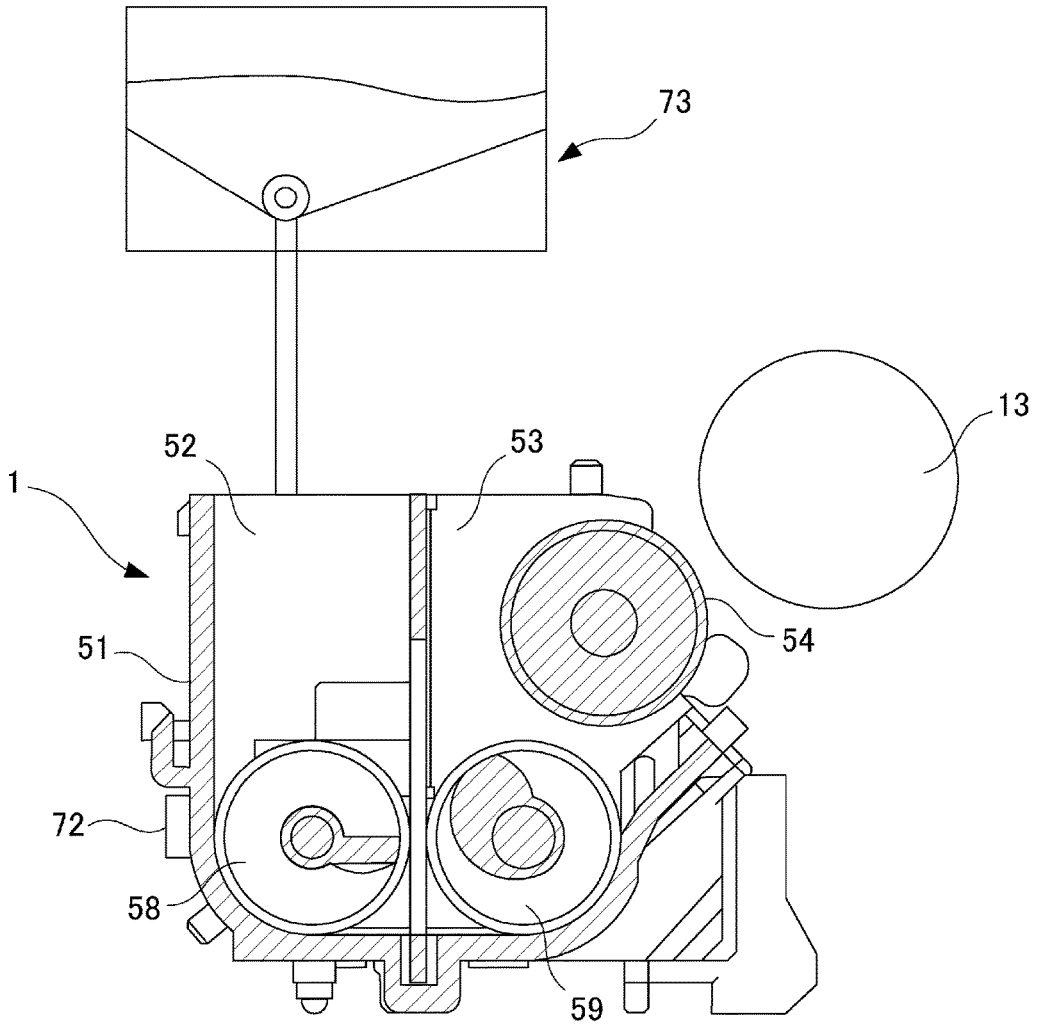
FIG. 4 is a sectional view of a combination of the developing apparatus and photosensitive drum in the image forming portion shown in FIG. 2.

Next, referring to FIGS. 3 and 4, the developing apparatuses 1Y-1K are described in detail about their structure. The developing apparatuses 1Y-1K are practically the same in structure, although they are different in the color of the toner stored therein. Thus, only the developing apparatus 1Y for developing the electrostatic latent image for forming a yellow toner image is described; the other developing apparatuses are not going to be described.

FIG. 3 is a schematic top view of the developing apparatus 1Y after the removal of its top lid. Referring to FIG. 3, the developing apparatus 1Y is provided with a developer container 51, in which two-component developer made up of toner and carrier is stored. The developer container 51 has two chambers, more specifically, a stirring chamber 52 and a development chamber 53, which are separated by a partition wall 57, and through which developer is conveyed. The partition wall 57 is provided with a pair of through holes 55 and 56, which are at the lengthwise end portions of the partition wall 57, one for one, and through which developer is transferred from one chamber to the other. In other words, not only does the partition wall 57 divide the internal space of the developer container 51 into a pair of chambers, that is, the first chamber 52 as a stirring chamber, and the second chamber 53 as a development chamber, but also, is provided with the first and second through holes 56 and 55, which connect the first and second chambers.

By the way, in this embodiment, a mixture of nonmagnetic and negatively chargeable toner and magnetic carrier is used as the abovementioned developer. The nonmagnetic toner is powder made by mixing coloring agent, wax, etc., into such resin as polyester and styrene-acrylic, pulverizing (or polymerizing) the mixture, and adding micro-particles of titanium oxide, silica, etc., to the pulverized mixture to coat the surface of the resultant particles. The magnetic carrier is obtained by coating the surface of the resinous particles (cores) made of a mixture of ferrite particles, or the like magnetic particles, with resin. When the developer used in this embodiment is brand-new, its toner density (weight ratio of toner in developer) is 8%.

The stirring chamber 52 is provided with a conveyance screw 58 as a conveying member, whereas the development chamber 53 is provided with a conveyance screw 61 and a development sleeve 54. More concretely, in the stirring chamber 52, the conveyance screw 58 (first conveying member) is disposed along the abovementioned partition wall 57. The conveyance screw 58 is provided with a rotational shaft 58*a*, and a pair of spiral blades 58*b* and 58*c* wound around the rotational shaft 58*a*. It is rotated by driving force which it receives from an external power source by way of unshown gears. As the conveyance screw 58 rotates, developer is conveyed in the first direction (indicated by arrow mark 40 in FIG. 3), that is, the direction from the through hole 56 as the first through hole toward the through hole 55 as the second through hole 55, while being stirred by the spiral blade 58*b* (which hereafter may be referred to as normally spiraled blade).

On the other hand, in the development chamber 53, the conveyance screw 61 is disposed along the abovementioned partition wall 57. The conveyance screw 61 is provided with a rotational shaft 61*a* and a pair of spiral blades 61*b* and 61*c* wound around the rotational shaft 61*a*. It is rotated by the driving force which it receives from an external source by way of unshown gears. As the conveyance screw 61 rotates, the developer in the development chamber 53 is conveyed by the spiral blade 61*b* in the second direction (indicated by arrow mark 41 in FIG. 3), which is opposite from the first direction, that is, the direction from the through hole 55 toward the through hole 56, while being supplied to the development sleeve 54.

Next, referring to FIG. 4, in the development chamber 53, the development sleeve 54 is disposed above the conveyance screw 61, in parallel to the conveyance screw 61. More specifically, although the development sleeve 54 is practically in the development chamber 53 (second chamber), it is partially exposed from the development chamber 53 so that it opposes the photosensitive drum 13Y, as an image bearing member, to function as a developer bearing member which bears developer on its peripheral surface. Further, the stirring chamber 52 is provided with a toner density sensor 72 for detecting the toner density of the developer in the stirring chamber 52. The toner density sensor 72 is disposed so that its detection surface is exposed to face the conveyance screw 58. The image forming apparatus 100 is structured so that if an unshown control portion determines, based on the results of the detection by this toner density sensor 72, that the developer in the stirring chamber 52 is significantly low in toner density compared to the normal level, the replenishment toner in a toner bottle is supplied to the stirring chamber 52 by way of a toner replenishment portion 73.

For example, referring to FIG. 3, as the stirring chamber 52 is replenished with toner, the supplied toner is conveyed by the conveyance screw 58 in the direction indicated by the arrow mark 40 along with the developer which was in the stirring chamber 52, while being stirred and mixed with the developer which was in the stirring chamber 52. Then, it is transferred from the stirring chamber 52 to the development chamber 53 through the through hole 55. As the developer in the stirring chamber 52 is transferred to the development chamber 53, it is conveyed by the conveyance screw 61 in the direction indicated by the arrow mark 41, while a part of it is supplied to the development sleeve 54. The developer borne (supplied to) the development sleeve 54 is conveyed to the development area where the development sleeve 54 (and developer thereon) opposes the photosensitive drum 13Y. Then, as development bias is applied to the development sleeve 54, the toner jumps onto the electrostatic latent image on the photosensitive drum 13Y. Consequently, the electrostatic latent image is developed into a toner image.

As for the developer which was not supplied to the development sleeve 54, that is, the developer remaining in the development chamber 53, it is conveyed downstream by the conveyance screw 61 in the development chamber 53. Then, it is transferred back into the stirring chamber 52 through the through hole 56. That is, the developer in the developer container 51 is circulated through the container 51. As described above, in the developer container 51, a combination of the stirring chamber 52 (first chamber), development chamber 53 (second chamber), and the pair of through holes 55 and 56, makes up a circulatory developer passage, through which developer is circulated by the pair of conveyance screws 58 and 61 described above. As a combination of the replenishment toner and the developer in the developer container is made to circulate through this circulatory passage, the development sleeve 54 is supplied with developer which is uniform in toner density.

[Detailed Description of Structure of a Conveyance Screw 58]

Next, referring to FIGS. 5-7, the conveyance screw 58 is described in detail about its structure. Referring to FIG. 5, the conveyance screw 58 has two types of spiral blades (58*b* and 58*c*). The spiral blade 58*b* is such a spiral blade that is wound around the peripheral surface of the rotational shaft 58*a* at such an angle that it conveys the developer in the stirring chamber 52 toward the through hole 56. It functions as the first conveyance blade which conveys developer in the direction (first direction indicated by arrow mark 4 in FIG. 3) in which developer is circulated in the developing apparatus 1Y), in the stirring chamber 52 (first chamber). Hereafter, this spiral blade is referred to as the normally spiraled blade. As for the spiral blade 58*c*, it is such a spiral blade that functions as the second conveyance screw which conveys developer in the direction (second direction) which is opposite from the abovementioned developer circulation direction. This spiral blade, hereafter, is referred to as the reversely spiraled blade 58*c*. It is wound around the downstream end portion of the rotational shaft 58*a*, in terms of the developer circulation direction. It pushes back developer as developer flows into the downstream end portion of the stirring chamber 52, functioning as a member to prevent developer becomes stagnant in the downstream end portion of the stirring chamber 52.

By the way, in recent years, it has come to be desired that an image forming apparatus has two or more process speeds so that it can form images on various media. Thus, it has come to be desired that a developing apparatus which is mountable in such an image forming apparatus is capable of dealing with two or more process speeds in which an image forming apparatus can be operated, from the standpoint of reducing a combination of an electrophotographic image forming apparatus and a developing apparatus therefor, in manufacturing cost, and also, service cost.

Simply increasing an image forming apparatus in process speed is likely to cause the apparatus to output images which are inferior to the images outputted prior to the process speed increase. Thus, in order to enable an image forming apparatus to output images which are equal in quality to those prior to the increase in process speed, the image forming apparatus has to be increased in the speed of the conveyance screw of its developing apparatus. However, if the conveyance screw is increased in its rotational speed in proportion to the amount of increase in process speed of the image forming apparatus, it increases in the amount of force by which it conveys developer in its lengthwise direction, in proportion to the increase in its rotational speed. As the conveyance screw increases in the amount of force by which it conveys developer, the amount by which developer flows into the downstream portion of the stirring chamber/development chamber increases, making it impossible to reduce the developing apparatus in the speed with which developer is transferred from the stirring chamber to the development chamber, and vice versa. Therefore, it is possible for the developing apparatus to reduce in the efficiency with which developer is transferred between the two chambers. Further, the developer which failed to be transferred from one chamber to the other becomes stagnant in the downstream portion of the stirring chamber/development chamber. In other words, developer tends to collect in the downstream portion of the stirring chamber/development chamber. Consequently, it is likely for the image forming apparatus to output images which suffer from the nonuniformity or the like image defects which are attributable to developer overflow, unsatisfactory sleeve coating, and/or the like.

In this embodiment, therefore, there is provided a preset amount of distance between the downstream end of the normally spiraled blade 58*b*, and the upstream end of the reversely spiraled blade 58*c* in terms of the developer circulation direction. More concretely, the conveyance screw 58 is provided with a blade-free area 58*d*, which is between the normally spiraled blade 58*b* and reversely spiraled blade 58*c*. Further, the developing apparatus 1Y is structured so that at least a part of the blade-free area 58*d* faces the through hole 55. Structuring the developing apparatus 1Y so that the blade-free area 58*d*, that is, the area with spiraled blade, faces the through hole 55 can slow the developer in the blade-free area, as the developer is conveyed to the blade-free area 58*d* by the normally spiraled blade 58*d*. By the way, in this embodiment, the developing apparatus is structured so that, in terms of the first direction, the length of the abovementioned blade-free area 58*d*, that, the distance between the downstream end of the normally spiraled blade 58*b* and the upstream end of the reversely spiraled blade 58*c*, is greater than a half of the pitch P2 of the reversely spiraled blade 58*c*.

Further, on the downstream side of this blade-free area 58*d*, such force that works in the direction to push developer upstream from downstream is generated by the reversely spiraled blade 58*c*. Therefore, the developing apparatus 1Y is increased in the amount of the developer which faces the through hole 55.

Moreover, the conveyance screw 58 in this embodiment is provided with multiple (four in this embodiment) paddles 59*a*-59*d*, which are for efficiently transferring developer into the development chamber 53, as developer collects in the area of the stirring chamber 52, which faces the through hole 55. The paddles 59*a*-59*d* are attached to the blade-free area 58*d* of the rotational shaft 58*a*. In other words, the paddles 59*a*-59*d* are between the normally spiraled blade 58*b* and reversely spiraled blade 58*c*. They are such protrusive portions, like pieces of plate, that protrude from the peripheral surface of the rotational shaft 58*a* in the radius direction of the rotational shaft 58*a*, and also, that a part of each protrusive portion faces the through hole 55 in terms of the axial line of the rotational shaft 58*a*.

More concretely, referring to FIG. 6, in terms of the direction parallel to the rotational axis of the rotational shaft 58*a*, each of the paddles 58*a*-58*d* is shorter than through hole 55. More precisely, it is shorter than the portion of the blade-free area 58*d*, which faces the through hole 55. Further, the paddles 59*a*-59*d* are disposed so that they are parallel to the rotational axis of the rotational shaft 58*a*, and also, so that they are different in position in terms of the rotational axis of the rotational shaft 58*a*.

Moreover, the paddles 59*a*-59*d* are disposed so that the closer they are to the downstream end of the normally spiraled blade 58*b* in terms of the developer circulation direction (first direction), the more upstream they are in terms of the rotational direction of the spiral blade 58*b*. That is, in this embodiment, they are disposed so that, in their sectional view which is perpendicular to the rotational shaft 58*a*, they do not overlap with each other; in terms of the rotational direction of the rotational shaft 58*a*, they are separated by 90 degrees from their adjacent paddles.

By the way, the direction in which the paddles 59*a*-59*d* deviate in rotational phase is the same as the direction in which the normally spiraled blade 58*b* is wound as described above. The direction in which these paddles 59*a*-59*d* deviate in rotational phase may be the opposite from the direction in which the spiral blade is wound. In such a case, however, the paddle 59*d* is the first one to lift developer, followed by the paddles 59*c*, 59*b* and 59*a* in the listed order. Further, in the area of the stirring chamber 52, the developer conveyed thereto by the normally spiraled blade 58*b* collides with the developer lifted by the paddle 59*b*, resulting sometimes in jumping of developer.

In comparison, if the direction in which the paddles 59*a*-59*d* are made to deviate in rotational phase is made the same as the direction in which the normally spiraled blade 58*b* is wound, as developer is conveyed to the downstream end of the normally spiraled blade 58*b*, it comes into contact with the paddles 59*a*-59*d* in the listed order. Therefore, developer collision such as the one described above does not occur. Therefore, developer is efficiently transferred into the development chamber 53.

Further, the most upstream paddle 59*a* is directly in connection with normally spiraled blade 58*b*. Similarly, the most downstream paddle 59*d* is directly in connection with the reversely spiraled blade 58*c*.

Since the developing apparatus 1Y is structured as described above, the amount of force applied to developer by these paddles 59*a*-59*d* in the direction to convey developer in the direction parallel to the rotational direction of the conveyance screw 58 is greater than that applied to developer by conveyance screw 58 in the direction to convey developer in the developer circulation direction (first direction). As the conveyance screw 58 rotates, the developer in the adjacent area to the through hole 55 is scooped up by these paddles 59*a*-59*d*, being thereby nudged toward the development chamber. That is, the paddles 59*a*-59*d* function as such members that convey developer toward the development chamber.

[Test Results]

Next, referring to FIGS. 7 and 8, the results of the tests carried out to measure the height to which the top surface of the body of developer in the stirring chamber reached as the conveyance screw was rotated at various speed are described. By the way, in these tests, in order to quantify the degree of developer stagnation to evaluate the degree of the developer stagnation, the height (position of) the top surface of the body of developer in the stirring chamber was measured with the use of a laser-based displacement gauge (LJ-G080: product of KEYENCE Co., Ltd.). More concretely, referring to FIG. 7, the average height of the top surface of the portion of the body of developer in the area 60 which faces the through hole 55, from the bottom surface of the stirring chamber (developer container) was defined as the height of the top surface of the body of developer.

The test procedure was as follows: The developing apparatus 1Y shown in FIG. 3 was set on a device which was capable of driving the conveyance screws 58 and 59, and development sleeve 54. Next, 250 g of developer was placed in the developer container 51. Then, the conveyance screws 58 and 59, and development sleeve 54, were continuously rotated for 5 minutes, that is, until the top surface of the body of developer became stable. After 5 minutes, the driving of the screws was stopped, and the top lid was removed. Then, the height of the top surface of the body of developer in the area 60 which faces the through hole 55 was measured with the use of the abovementioned laser-based displacement gauge. This test procedure was carried out at a low process speed (rotational speed of conveyance screws 58 and 59 was 300 rpm) and a high speed (rotational speed of conveyance screws 58 and 59 was 600 rpm).

FIG. 8 shows the results of the tests carried out with the use of the conveyance screw in this embodiment, that is, a conveyance screw equipped with the paddles 59*a*-59*d* across its blade-free area 58*d*. FIG. 8 shows also the results of the tests carried out with the use of a comparative conveyance screw, that is, a conveyance screw having neither a blade-free area 58 nor a paddles 59*a*-59*d*, that is, a conveyance screw, the normally spiraled blade 58*b* is directly in connection to the reversely spiraled blade 58*c*.

By the way, in these tests, in a case where when the rotation of the conveyance screw was stopped, the height of the top surface of the body of developer was greater than the external diameter (20 mm) of the conveyance screw, and therefore, the screw could not be seen, it was determined that the conveyance screw was unacceptable in terms of developer transfer performance. In these tests, the performance of the screws was evaluated with reference to the external diameter of the screws as described above. However, the developer transfer performance of a conveyance screw is affected by the shape of the developer container, shape of the through hole, etc. Therefore, the reference to be used to evaluate a conveyance screw in terms of developer transfer performance does not need to be limited to the external diameter of the screw.

Referring to FIG. 8, in the case of the comparative conveyance screw which does not have the blade-free area 58*d* and paddles 59*a*-59*d*, it is only at the low speed that the height of the top surface of the body of developer is within an acceptable range. At the high speed, however, it failed to satisfactorily transfer the developer, allowing therefore the developer to become stagnant in the downstream end portion of the stirring chamber 52. Therefore, the top surface of the body of developer rose into an unacceptable range. In comparison, in this embodiment, developer was satisfactorily slowed in the blade-free area 58*d*, and then, was transferred into the development chamber 53 by the paddles 59*a*-59*d*. Therefore, the height of the top surface of the body of developer remained within the acceptable range.

As described above, according to this embodiment, the portion 58*d* of the conveyance screw, which is between the downstream end of the normally spiraled blade 58*b* in terms of the developer conveyance direction, and the upstream end of the reversely spiraled blade 58*c*, is made blade-free (blade-free area 58*d*). Further, the blade-free portion 58*d* of the conveyance screw is provided with the paddling members 59*a*-59*d* dedicated to developer transfer. Moreover, the paddling members 59*a*-59*d* are positioned so that they are different in position in terms of not only the rotational direction of the conveyance screw, but also, the lengthwise direction of the screw. Therefore, even when the conveyance screw is rotated at a higher speed, it is possible to prevent developer from becoming stagnant in the downstream end portion of the conveyance chamber. Therefore, it is possible to prevent the lengthwise end portions of the development sleeve 54 from being undesirably coated with developer. Therefore, it is possible to prevent the image forming apparatus 100 from outputting images which are nonuniform in density across the areas which correspond to the lengthwise end portions of the development sleeve 54. Moreover, it is possible to prevent developer from overflowing from the development chamber 53.

Embodiment 2

Next, referring to FIGS. 9 and 10, the second embodiment of the present invention is described. By the way, the second embodiment is different from the first embodiment only in that the conveyance screw 58 in the second embodiment is provided with a reversely spiraled blade 58*c* which is made up of two sub-blades which are reversely spiraled. Therefore, in the following description of the second embodiment, the description is concentrated to the structure of the reversely spiraled blade 58*c*. That is, the components of the developing apparatus 1Y in this embodiment, which are similar in structure to the counterparts in the first embodiment are not described.

The greater the reversely spiraled blade 58*c* is in the developer conveyance force, the greater it is in the amount by which it holds developer in the area in which the paddles 59*a*-58*d* are present, and therefore, the greater it is in the effect of the presence of the paddles 59*a*-59*d*. In this embodiment, therefore, the reversely spiraled blade 58*c* is made up of two spiraled sub-blades which are parallel to each other. Its pitch P2 is set as follows:

The conveyance screw 58 is structured so that it satisfies the following mathematical formulas (1) and (2), in which the pitch of the normally spiraled blade 58*b* is P1; the pitch of the reversely spiraled blade 58*c* is P2; the number of spiral sub-blades of the reversely spiraled blade 58*c* is n; and the length of the area through which developer is conveyed backward is L. By the way, in this embodiment, value of the sub-blade count n is a natural number which is two or greater. However, in a case where the reversely spiraled blade 58*c* does not have two or more spiraled sub-blades, the value of the sub-blade count n is a natural number which is one or greater:

$$P2 \geq P1 \quad (1)$$

$$n \times L > P2 \quad (2)$$

Formula (1) shows the relationship between the pitch of the reversely spiraled blade 58*c* and that of the normally spiraled blade 58*b*. In this embodiment, the pitch of the reversely spiraled blade 58*c* is equal to, or greater than, the pitch of the normally spiraled blade 58*b*.

Formula (2) shows that, in the reverse conveyance area, as the conveyance screw is seen from the direction parallel to the axial line of the screw at a given point in terms of the circumference direction of the screw, at least one stirring sub-blade is present regardless of the location of the point in terms of the circumferential direction of the sleeve. It is desired that two or more sub-blades are present. For example, the reversely spiraled blade 58*c* is desired to be structured so that it is 20 mm in the blade pitch P1, 20 mm in the length L, and 4 in the sub-blade count n. This structural arrangement makes it possible that as the reversely spiraled blade 58*c* is seen from the direction which is parallel to the conveyance screw 58, at a given point in terms of the circumferential direction of the screw, two or more sub-blades are present regardless of the position of the given point in terms of the circumferential direction of the conveyance screw 58.

By setting the blade pitch P2 of the reversely spiraled blade 58*c* so that Formula (1) is satisfied, it is possible to make the amount by which developer is conveyed per rotation of the reversely spiraled blade 58*c*, greater than that by the normally spiraled blade 58*b*.

Further, if the reversely spiraled blade 58*c* is provided with two or more sub-blades, and the sub-blade count n and the length L of the reversal conveyance area, are set relative to the blade pitch P2 of the reversely spiraled blade 58*c* so that Formula (2) is satisfied, the reversely spiraled blade 58*c* conveys developer n times per rotation, being therefore capable of more efficiently pushing developer back.

Structuring the reversely spiraled blade 58*c* (conveyance screw 58) as described above increases the reversely spiraled blade 58*c* in developer conveyance force, and therefore, the developing apparatus 1Y is increased in the effectiveness with which developer is transferred by the developer transfer paddles 59*a*-59*d*. That is, this embodiment makes it possible to more effectively prevent the developer stagnation which is likely to occur in the downstream portion of the developer conveyance chamber than the first embodiment. Thus, it can prevent the developer stagnation described above even if the conveyance screw is increased in rotation.

Embodiment 3

Next, referring to FIGS. 11-14, the third embodiment of the present invention is described. By the way, this embodiment is different from the first and second embodiment only in that the paddles in this embodiment are tilted relative to the rotational axis of the conveyance screw 58. Thus, the following description of this embodiment is concentrated to the paddle structure. That is, the structural components of the developing apparatus in this embodiment, which are similar in structure to the counterparts in the first and second embodiments are not described.

Referring to FIG. 10, in the second embodiment, the conveyance screw 58 is structured so that its paddles 59*a*-59*d* are parallel to the rotational axis 70 of the conveyance screw 58. Thus, the direction P in which force is applied to developer by the paddles 59*a*-59*d* to convey the developer is 90° relative to the conveyance direction 40.

This structural arrangement, however, allows developer to quickly decelerate as developer reaches the blade-free area 58*d*. Therefore, it increases the amount by which developer stagnates in the adjacencies of the paddle 59*a*. On the other hand, developer fails to reach the adjacencies of the paddles 59*c* and 59*d* by a satisfactory amount. That is, the adjacencies of the paddles 59*c* and 59*d* are insufficiently supplied with developer.

That is, the adjacencies of the paddle 59*a* are provided with an excessive amount of developer, and therefore, the paddles 59*a* fails to come into contact with some of the developer in the adjacencies of the paddles 59*a*. Thus, the developing apparatus 1Y is reduced in the developer transfer efficiency. On the other hand, the adjacencies of the paddles 59*c* and 59*d* are provided with an insufficient amount of developer, making it impossible for the paddles 59*c* and 59*d* to transferring developer by a sufficient amount, reducing thereby the developing apparatus 1Y in the developer transfer efficiency.

In comparison, referring to FIG. 11, in this embodiment, the paddles 59*a*-59*d* are tilted by a preset angle θ relative to the rotational axis 70 of the rotational shaft 58*a*, so that the downstream end of each of the paddles 59*a*-59*d* in terms of the developer circulation direction, is positioned upstream of the upstream end of the paddle 59 in terms of the rotational direction of the conveyance screw 58. That is, the surface of each paddle 59 is tilted relative to the rotational axis 70. Since the paddles 59*a*-59*d* are tilted as described above, the direction P in which force is applied to developer by the paddles 59*a*-59*d* to convey the developer is (90-θ)° relative to the rotational axis 70. That is, the third embodiment is greater than the second embodiment, in the first directional component of the force applied to developer by the paddles 59*a*-59*d*, being therefore greater in the amount by which developer is delivered to the adjacencies of the paddles 59*c* and 59*d*. Therefore, this embodiment is smaller in the amount by which developer collects in the adjacencies of the border between the normally spiraled blade 58*b* and blade-free area 58*d* than the second embodiment. In this case, the contour of the top surface of the body of developer appears as indicated by a dotted line in part (b) of FIG. 12. This embodiment is greater than the second embodiment, in the amount by which developer is delivered to the adjacencies of the paddles 59*c* and 59*d*, being therefore greater in the amount by which developer comes into contact with the paddle surface. Therefore, the paddles 59*c* and 59*d* are better utilized in their developer transfer performance. In this embodiment, θ is desired to be no less than 10° and no more than 45°, preferably, no less than 20° and no more than 40°.

In order to confirm the effects of this embodiment, the height of the top surface of the body of developer in the developer transfer area in the downstream portion of the stirring chamber 52 was measured with the use of a laser-based displacement gauge (LJ-G080: product of KEYENCE Co., Ltd.) in tests which are similar to those carried out to test the effectiveness of the first embodiment. More concretely, a conveyance screw, each of the paddles of which was tilted by 30° relative to the rotational axis of the conveyance screw 58, was employed as the conveyance screw 58. As comparative conveyance screws, a conveyance screw, each of the paddles of which was tilted by 0°, and a conveyance screw, each of the paddles of which was tilted by −30° (tilted in opposite direction from this embodiment), were used.

Following are the test procedure and test results. In these tests, only the developing apparatus 1Y shown in FIG. 3 was set on a device which was capable of driving the conveyance screws 58 and 59, and development sleeve 54. The revolution of the conveyance screws 58 and 59 was set to 600 rpm. First, 250 g of developer was placed in the developer container 51. Then, the conveyance screws 58 and 59, and development sleeve 54, were continuously rotated for 5 minutes, that is, until the top surface of the body of developer became stable. After 5 minutes, the driving of the screws was stopped, and the top lid was removed. Then, the height of the top surface of the body of developer in the stirring chamber 52 was measured with the use of the abovementioned laser-based displacement gauge. FIG. 13 is a graph which shows the results of the tests.

In FIG. 13, the horizontal axis of the graph represents the location in the stirring chamber 52 in terms of the lengthwise direction. The left side of FIG. 13 corresponds to the upstream side in terms of the developer circulation direction, and the right side corresponds to the downstream side. The conveyance screw 58 which is on the top side of the graph corresponds to the graph in size and positioning in terms of its lengthwise direction (horizontal axis of graph). The vertical axis of the graph represents the height of the top surface of the body of developer. The origin of the graph corresponds to the position of the bottom surface of the stirring chamber 52.

As is evident from the graph in FIG. 13, in a case where the inclination of the paddles 59*a*-59*d* relative to the rotational axis is 0°, a large amount of developer was present in the adjacencies of the paddle 59*a*, whereas the adjacencies of the paddle 59*d* were smaller in the amount of developer. In the adjacencies of the paddle 59*a*, the top surface of the body of developer was above the highest reach of the conveyance screw 58. Therefore, there was developer which the paddle did not contact, in the adjacencies of the paddle 59*a*. If the paddles 59 are tilted in the opposite direction (−60°) from the direction in which they are tilted in this embodiment, it is more likely for developer to collect in the adjacencies of the paddle 59*a*, and it is more likely for the adjacencies of the paddles 59*d* to be reduced in the amount of developer. Thus, the developing apparatus is further reduced in the overall efficiency with which developer is transferred by the paddles 59*a*-59*d*.

In comparison, in a case where the paddles 59*a*-59*d* are tilted as they are in this embodiment, developer is evenly distributed across the blade-free area 58*d*. That is, there is no excessive amount of stagnant developer in the adjacencies of the paddle 59*a*; the top surface of the body of developer is lower than the highest reach of the paddle 59*a*. Therefore, the developing apparatus 1Y is better in the efficiency with which developer is transferred by the paddle 59*a*. Moreover, the adjacencies of the paddles 59*c* and 59*d* are supplied with a satisfactory amount of developer. Therefore, the surfaces of the paddles 59*c* and 59*d* are fully utilized. Therefore, the developing apparatus 1Y is better in the overall efficiency with which developer is transferred by the paddles 59*a*-59*d*.

Further, as the developing apparatus 1Y is improved in developer transfer performance by a structural arrangement such as the one in this embodiment, more developer can be sent to the development chamber 53. Therefore, it is possible to reduce the amount by which the developing apparatus 1Y has to be supplied with developer to supply the development sleeve 54 with a satisfactory amount of developer (amount necessary to coat sleeve).

By the way, in this embodiment, the angle θ of the paddles 59*a*-59*d* are desired to be made smaller than the lead angle φ of the conveyance screw 58 (FIG. 14), because if the paddle angle is greater than the lead angle of the conveyance screw 58 (θ>φ), developer cannot be changed in direction (directional component of its vector) as it is made to reach the paddles 59*a*-59*d* by the normally spiraled blade 58*b*.

<Miscellanies>

The preceding embodiments are only a few of preferred embodiments of the present invention, and are not intended to limit the present invention in scope. That is, the present invention is also applicable to developing apparatuses which are different in structure from those in the preceding embodiments. For example, it is applicable to developing apparatuses which are different in the paddle count from those in the first to third embodiments. Regarding the angular interval between the adjacent two paddles, it is desired to be a value obtainable by dividing 360° by paddle count. For example, if the paddle count is two, the interval is desired to be 180°, and if it is three, the interval is desired to be 120°.

Similarly, the present invention is also applicable to developing apparatuses different in reversely spiraled blade count n. In a case where the present invention is applied to a developing apparatus which is different in reversely spiraled blade count n, it is desired that the paddles count is equal to the sub-blade count n of the reversely spiraled blade 58*c*. However, this requirement is not mandatory.

Further, in the preceding embodiments described above, the developing apparatuses were structured so that, as the blade-free area 58*d* and paddles 59*a*-59*d* seen from the direction perpendicular to the rotational axis of the conveyance screw 58, they overlap only partially with the through hole 55. These embodiments, however, are not intended to limit the present invention in scope. For example, the present invention is also applicable to a developing apparatus structured so that its blade-free area 58*d* and/or paddles 59*a*-59*d* completely overlap with the through hole 55. Also in the preceding embodiments, the developing apparatuses were structured so that, in order to make a part of the reversely spiraled blade 58*c* overlap with the through hole 55 as seen from the direction perpendicular to the rotational axis of the conveyance screw 58, at least a part of the reversely spiraled blade 58*c* is disposed on the upstream side of the through hole 55. However, the present invention is also applicable to a developing apparatus structured so that the entirety of its reversely spiraled blade 58*c* is on the downstream side of the through hole 55.

Moreover, in the preceding embodiments described above, the paddles 59*a*-59*d* were positioned so that they do not overlap with each other as they are seen from the circumferential direction of the conveyance screw 58. However, these embodiments are not intended to limit the present invention in scope. That is, the present invention is also compatible with a developing apparatus structured so that these paddles partially overlap with each other. Further, in the preceding embodiments, the present invention was applied to the structure of the conveyance screw 58 with which the stirring chamber 52 is provided. The same structure can be used for the conveyance screw 61 with which the development chamber 53 is provided. Moreover, the present invention is compatible with any combination of the above-described structural arrangements for a developing apparatus.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-148551 filed on Jul. 31, 2017, which is hereby incorporated by reference herein in its entirety.

What is claimed is:

1. A developing apparatus comprising:

a developer carrying member configured to carry a developer;

a developer container configured to accommodate the developer to be supplied to said developer carrying member;

a partition partitioning said developer container into a first chamber and a second chamber and provided with first and second communication ports for fluid communication between said first chamber and said second chamber;

a first feeding member provided in said first chamber and configured to feed the developer in a first direction from said first communication port toward said second communication port; and a second feeding member provided in said second chamber and configured to feed the developer in a second direction opposite to the first direction, wherein said first feeding member includes, a rotation shaft, a first helical portion provided on an outer periphery of said rotation shaft and configured to feed the developer in the first direction, a first plate-like projection projecting in a radial direction from the outer periphery of said rotation shaft at a position opposed to said second communication port in a downstream side of said first helical portion with respect to the first direction, and a second plate-like projection projecting in the radial direction from the outer periphery of said rotation shaft at a position which is opposed to said second communication port in a downstream side of said first plate-like projection with respect to the first direction and which is different from said first plate-like projection in a phase with respect to a rotational moving direction of said rotation shaft, said second plate-like projection being spaced from said first plate-like projection, wherein a plate-like surface of said first plate-like projection and a plate-like surface of said second plate-like projection are inclined relative to a rotational axis of said rotation shaft.

2. An apparatus according to claim 1, wherein angles of the inclinations are not less than 10° and not more than 45°.

3. An apparatus according to claim 1, wherein angles of the inclinations are not less than 20° and not more than 40°.

4. An apparatus according to claim 1, wherein angles of the inclinations are smaller than a lead angle of said first helical portion.

5. An apparatus according to claim 1, wherein said first feeding member is provided, downstream of said second plate-like projection with respect to the first direction, with a second helical portion configured to feed the developer in the second direction.

6. An apparatus according to claim 5, wherein said second helical portion is a multiple-thread helical portion.

7. An apparatus according to claim 1, wherein said second feeding member supplies the developer to said developer carrying member.

* * * * *